US007854618B2

(12) United States Patent
Liu et al.

(10) Patent No.: US 7,854,618 B2
(45) Date of Patent: Dec. 21, 2010

(54) WIRE CONNECTOR SYSTEM WITH LOCK MECHANISM

(75) Inventors: Yy Liu, Shenzhen (CN); HaoRan Zou, Shenzhen (CN)

(73) Assignees: BizConn International Corporation (ShenZhen), ShenZhen (CN); BizLink USA Technology Inc., Fremont, CA (US)

( * ) Notice: Subject to any disclaimer, the term of this patent is extended or adjusted under 35 U.S.C. 154(b) by 0 days.

(21) Appl. No.: 12/540,648

(22) Filed: Aug. 13, 2009

(65) Prior Publication Data

US 2010/0124832 A1 May 20, 2010

(30) Foreign Application Priority Data

Nov. 17, 2008 (CN) ..... 2008 2 0213627 U

(51) Int. Cl.
*H01R 13/44* (2006.01)

(52) U.S. Cl. ..... 439/131

(58) Field of Classification Search ..... 439/131, 439/954, 31, 640, 76.1, 945
See application file for complete search history.

(56) References Cited

U.S. PATENT DOCUMENTS 6,991,467 B1 * 1/2006 Cheng et al. ..... 439/10
6,999,322 B1 * 2/2006 Lin ..... 361/752
7,037,120 B1 * 5/2006 Yeh ..... 439/131
7,121,852 B2 * 10/2006 Ng et al. ..... 439/131
7,125,267 B1 * 10/2006 Yeh ..... 439/131
7,740,492 B2 * 6/2010 Dei Rossi et al. ..... 439/131
2008/0160802 A1 * 7/2008 Ni et al. ..... 439/131
2008/0160803 A1 * 7/2008 Morganstern et al. ..... 439/131
2009/0275224 A1 * 11/2009 Ni et al. ..... 439/131

* cited by examiner

*Primary Examiner*—Jean F Duverne
(74) *Attorney, Agent, or Firm*—Grace Lee Huang; Arch Equity Holdings, LLC

(57) ABSTRACT

A male wire connector system with lock mechanism, comprising: a housing assembly; a plug assembly moveably connected to the housing assembly; a jack assembly within the plug assembly comprising a plurality of terminals attached to a stopper mounted at the end thereof; a metal body assembly within the housing assembly and connected with the slide assembly and the cable wire; a cable extended from the housing assembly; and a slide assembly disposed on the top of the jack assembly slidable between the plug assembly and the cable within a predetermined distance by manipulation. The slide assembly is mechanically engaged with the plug assembly, the jack assembly, the metal body assembly, the housing assembly and the wire, triggering the forward and backward movement of the plug assembly. The male wire connector system can be securely locked or easily released from the female receptor when user manipulates the housing assembly.

23 Claims, 7 Drawing Sheets

WIRE CONNECTOR SYSTEM WITH LOCK MECHANISM

CROSS-REFERENCE TO RELATED APPLICATIONS

This application claims the benefit of foreign application with application number 200820213627.5, filed Nov. 17, 2008, and entitled "Wire Connector System", which is hereby incorporated herein by reference in its entirety.

FIELD OF THE INVENTION

The present invention relates to the wire connector system. More specifically, the present invention relates to the user-friendly male wire connector system with lock mechanism for engaging securely with the female receptor.

BACKGROUND OF THE INVENTION

The wire connector typically requires an electrical male wire system coupled with another piece of female electrical equipment. The other piece of electrical equipment can be the electrical components such as TVs, monitors or the computers. The conventional male wire system with plug-in member to connect with the female equipment tends to be less than optimally secure. The wire system is apt to loosen and become disconnected when the exposed wire was pulled by the general force.

The other conventional male wire connector contains a protruded barb mounted on the top of the plug-in member, and a piece of flexible projection mounted on the top of the male wire connector. The locking mechanism is substantially improved by inserting the male connector into the female device such that the barb and the flexible projection are interlocked in the corresponding portion of the female device. However, if the exposed wire is pulled by extra force, the inside parts of the female device can be severely damaged or dragged apart by the male connector since the male wire and female device are still interlocked together. Moreover, in order to release the male wire from the female device, the user has to press down the flexible tab onto the male wire. The process is usually tedious and not user-friendly.

It would be desirable to provide a male wire connector that provides a safety and convenient locking mechanism. For example, it would be desirable to provide the male wire connector that is user friendly for regular usage. It would also be desirable to provide the male wire connector that can couple with and lock into the female device safely but also can be released from the female device without damaging the inside electrical parts of the female device.

SUMMARY

Disclosed herein is a wire connector system. In one embodiment, a male wire connector system with lock mechanism, comprising: (a) a housing assembly, comprising an upper case and a lower case, the housing assembly having a first end containing a wire aperture to engage a conductive cable and a second end disposed opposite the first end; (b) a plug assembly moveably connected to the second end of the housing assembly and housed partially within the housing assembly; (c) a jack assembly engaged within the plug assembly, comprising a plurality of terminals engaged in a lined array and attached to a stopper mounted at the end portions thereof and housed with the jack assembly; (d) a cable extended through and outwardly from the housing assembly; and (e) a slide assembly disposed on the top of the jack assembly capable of being slidably moving between the plug assembly and the cable for manipulation, comprising a front part being slidably inserted into the plug assembly and a rear part being slidably inserted into the upper case of the housing assembly; wherein the housing assembly, the jack assembly and the cable are adapted to couple with the slide assembly being capable of moving in a forward or a backward directions within a predetermined distance for allowing the retractable movement of the plug assembly; wherein forward movement of the slide assembly within predetermined distance provides a resilient push force making the plug assembly outward from the housing assembly and being biased to engage with a female receptor; wherein backward movement of the slide assembly within predetermined distance provides a resilient retractable force releasing the plug assembly from the female receptor.

According to further embodiments of the present invention, a male wire connector system with lock mechanism, comprising: (a) a housing assembly, comprising an upper case and a lower case, the housing assembly having a first end containing a wire aperture to engage a conductive cable and a second end disposed opposite the first end; (b) a plug assembly moveably connected to the second end of the housing assembly and housed partially within the housing assembly; (c) a jack assembly engaged within the plug assembly, comprising a plurality of terminals engaged in a lined array and attached to a stopper mounted at the end thereof and housed with the jack assembly; (d) a metal body assembly housed within the housing assembly connected with the slide assembly and the cable wire, the metal body assembly comprising an upper metal case slidably engaged with the slide assembly, and a lower metal case engaged partially with the cable, the jack assembly and the slide assembly; (e) a cable extended through and outwardly from the housing assembly and the metal body assembly; and (f) a slide assembly disposed on the top of the jack assembly capable of being slidably moving between the plug assembly and the cable for manipulation, comprising, a front part being slidably inserted into the plug assembly, and a rear part being slidably inserted into the upper case of the metal body assembly through the upper case of the housing assembly; wherein the housing assembly, the metal case body, the jack assembly and the cable are adapted to couple with the slide assembly being capable of moving in a forward or a backward directions within a predetermined distance for allowing the retractable movement of the plug assembly; wherein forward movement of the slide assembly within predetermined distance provides a resilient push force making the plug assembly outward from the housing assembly and being biased to engage with a female receptor; wherein backward movement of the slide assembly within predetermined distance provides a resilient retractable force releasing the plug assembly from the female receptor.

While multiple embodiments are disclosed, still other embodiments of the present invention will become apparent to those skilled in the art from the following detailed description, which shows and describes illustrative embodiments of the invention. As will be realized, the invention is capable of modifications in various aspects, all without departing from the spirit and scope of the present invention. Accordingly, the drawings and detailed description are to be regarded as illustrative in nature and not restrictive.

DETAILED DESCRIPTION

Figure 1:
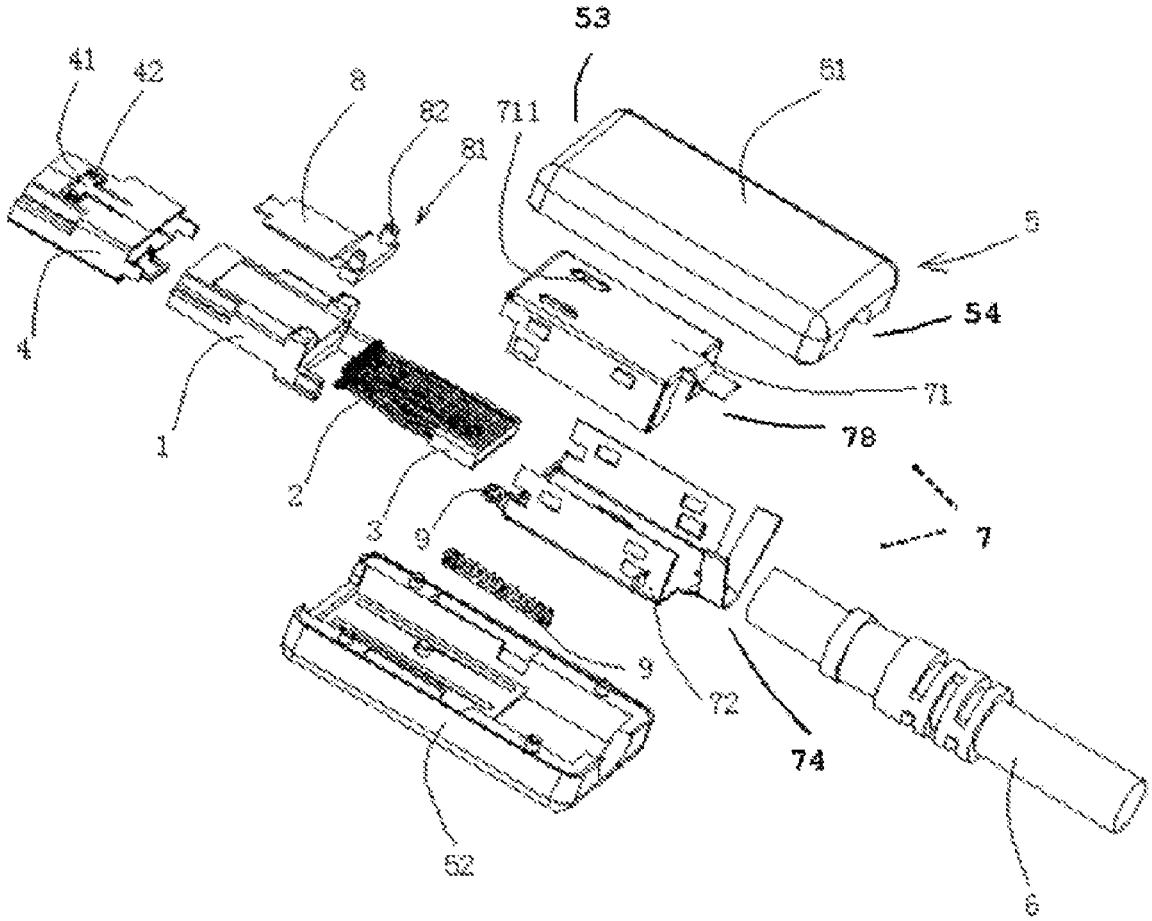
FIG. 1 is an exploded, perspective view of the components of the wire connector system according to the embodiment of the present invention.

Disclosed herein is a wire connector system 100. An embodiment of the wire connector system 100 of the present invention includes, as shown in FIG. 1, a housing assembly 5, a plug assembly 4, a jack assembly 1, a cable wire 6, a metal body assembly 7, and a slide assembly 81.

As shown in FIG. 1, the male wire connector system 100 may be operatively plugged and connected into the female ports of conventional electronic devices, such as TVs, monitors, computers, etc. therebetween in known matter. Moreover, the male wire connector system 100 provides a locking mechanism to securely lock with the female receptor. The housing assembly 5 includes an upper case 51 and a lower case 52. The two cases 51, 52 are made of non-conductive material, including, without limit to, insulating synthetic polymer materials or plastic materials to shield a user from the electrically conductive material housed with the housing assembly 5.

As shown in FIG. 1, the housing assembly 5 has a first end 54 and a second end 53. The first end 54 of the housing assembly 5 defines a wire aperture for receiving a cable wire 6. The second end 53 of the housing assembly 5, disposed opposite the first end 54, attaches to the plug assembly 4 as shown in FIG. 2.

Figure 2:
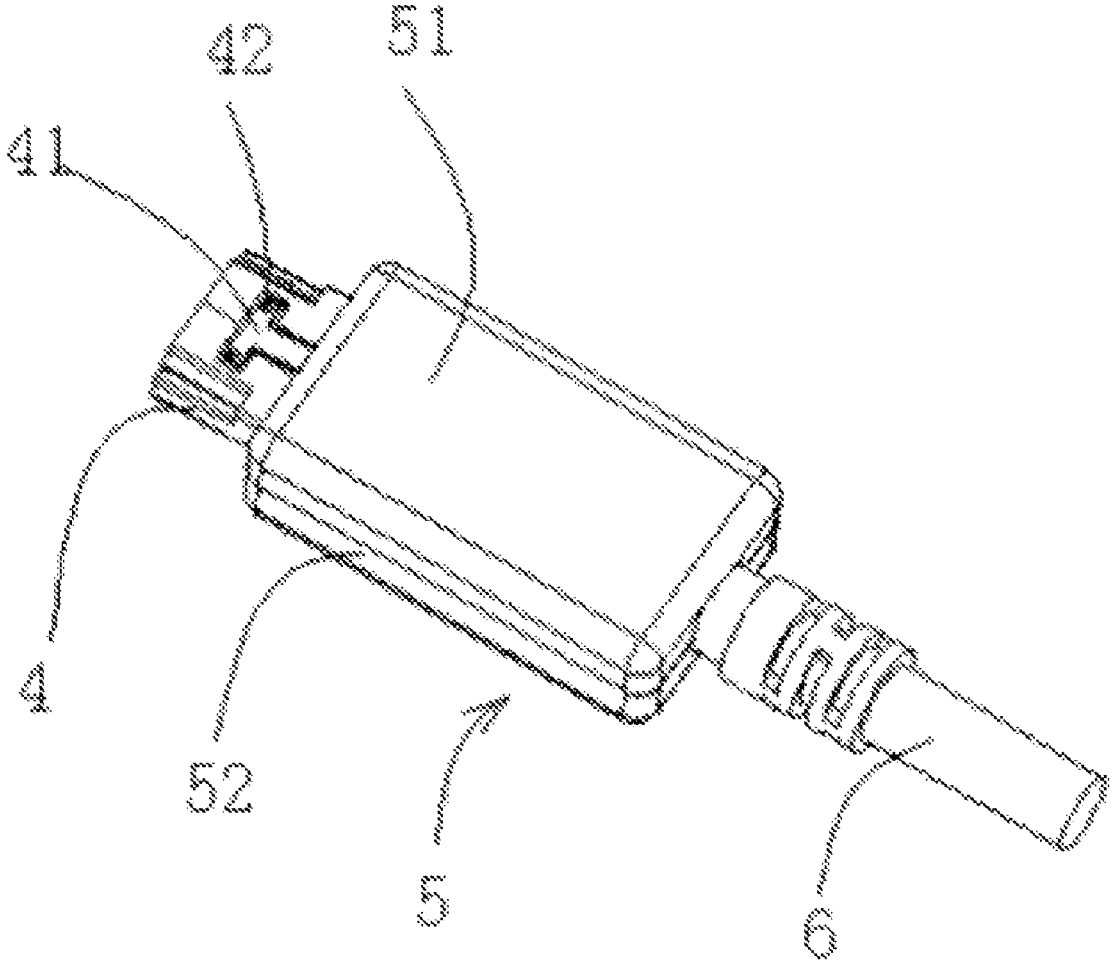
FIG. 2 is a top, perspective view of the wire connector system of FIG. 1 in a coupled position.
Figure 3:
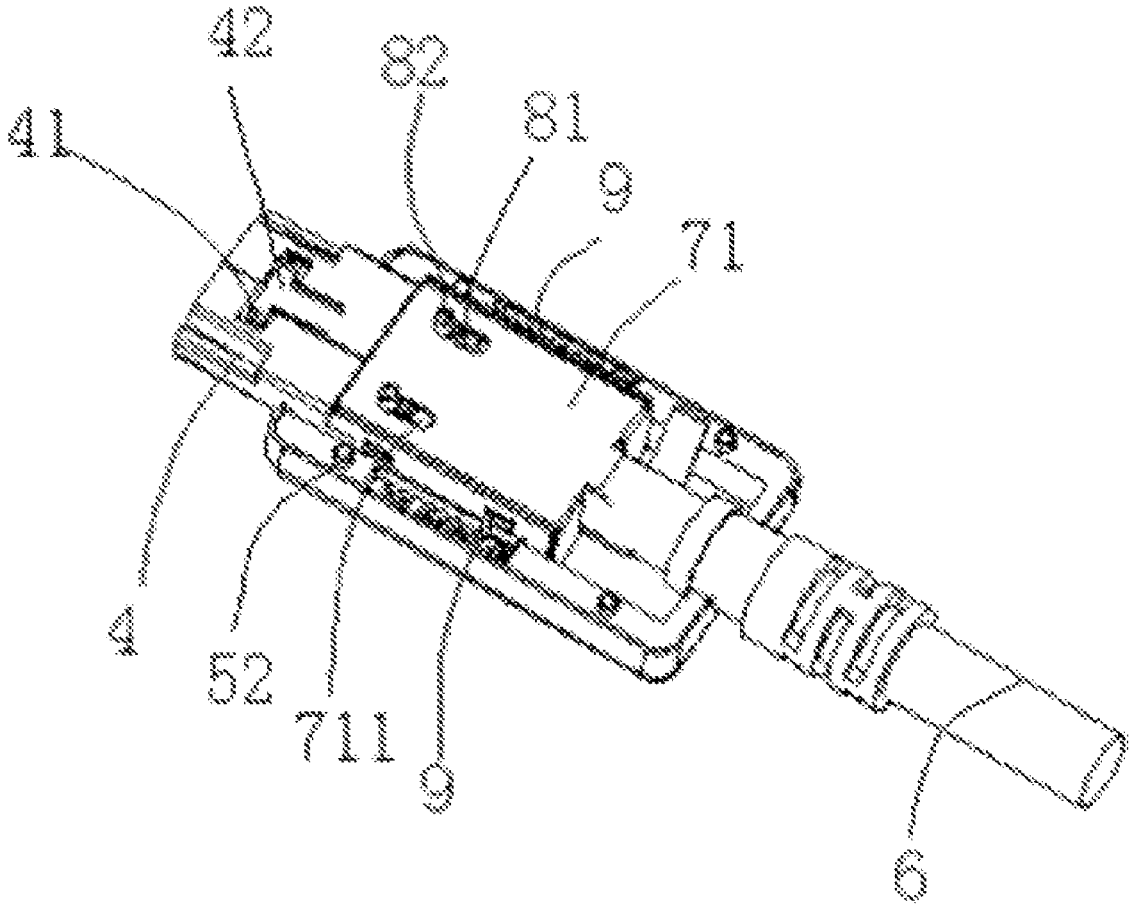
FIG. 3 is a top, perspective view of the system of FIG. 2, wherein the non-conductive upper case is removed.
Figure 4:
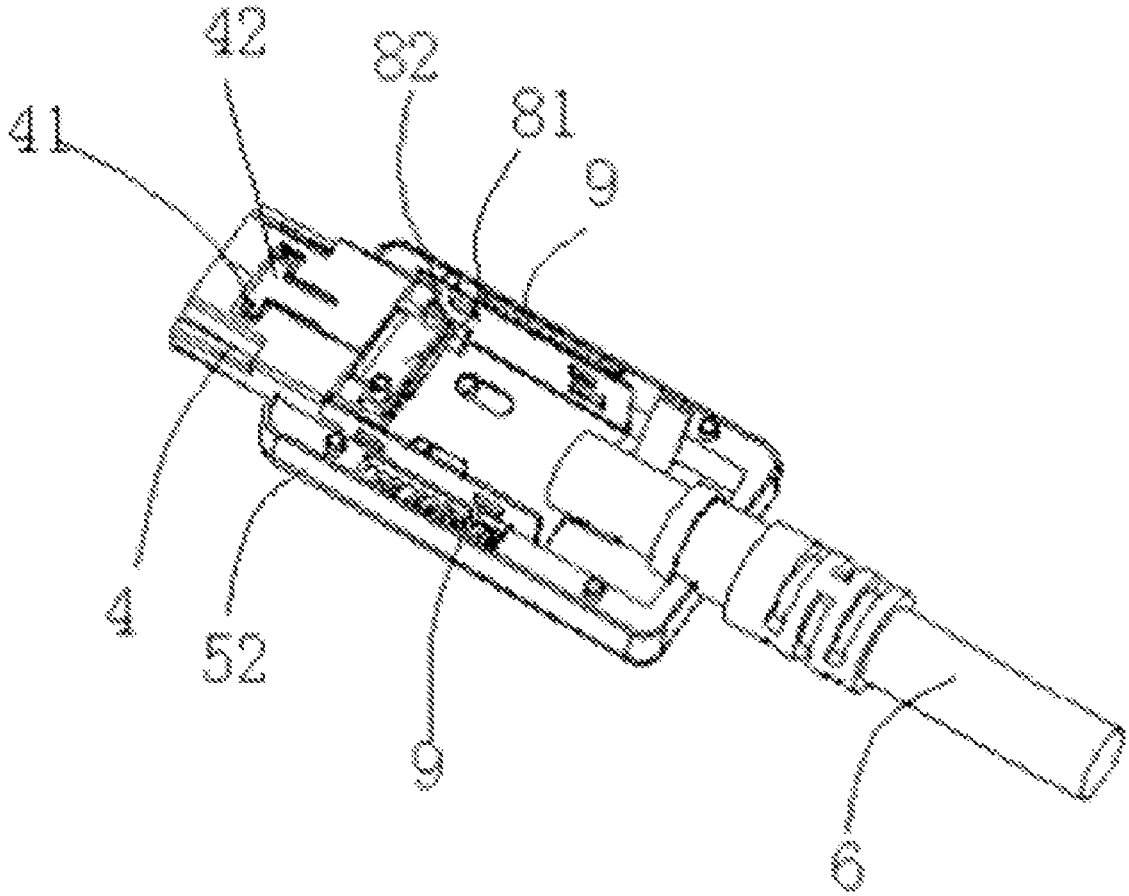
FIG. 4 is a top, perspective view of the system of FIG. 3, wherein the upper metal case is removed.

As shown in FIGS. 1-4, the plug assembly 4 is moveably connected to the second end 53 of the housing assembly 5. In one embodiment, the plug assembly 4 is partially housed inside the housing assembly 5. As shown in FIGS. 2-4, the plug assembly 4 is exposed outside the housing assembly 5. The plug assembly 4 serves as a male connector and can be inserted into the female receptor available in the conventional electronic devices, including, but not limit to, the monitors, TV, computers of the like, therefore providing the electrical connection with the electronic devices. In the present invention, the wire system 100 provides a retractable locking function to enable the plug assembly 4 being securely locked with the female receptor.

Figure 5:
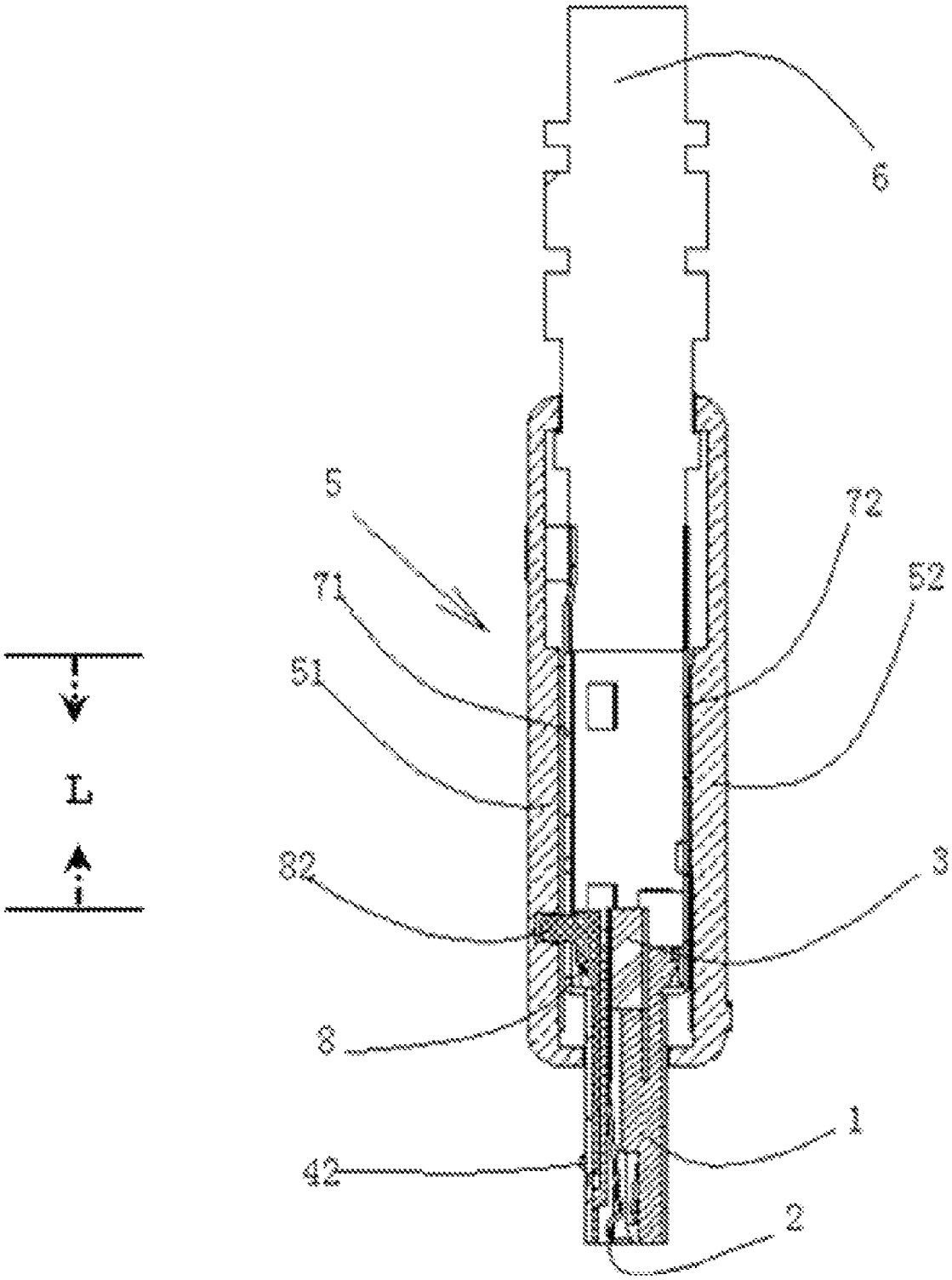
FIG. 5 is a partial cross-sectional view of the connector system of FIG. 2 taken along the line 6-6 of FIG. 1.

As shown in FIGS. 1, 4-5, the cable 6 is partially disposed within the wire aperture of the first end 54 of the housing assembly 5, and aligned by the metal body assembly 7.

As shown in FIGS. 1-5, the slide assembly 81 is located on the top of the jack assembly 1, and disposed within the plug assembly 4 and the cable 6. The slide assembly 81 is configured to be able to slide between the plug assembly 4 and the cable 6. The slide assembly 81 includes a tongue-shaped front part 8 and a rear part. The front part tongue 8 is slidably inserted into the plug assembly 4. In one embodiment, the rear part has a pair of cylindrical projections 82 being able to slidably insert with the upper metal case 71, together with the upper case 51 of the housing assembly 5. In a second embodiment, the rear part of the slide assembly 81 has a pair of sliding slots being able to slidably insert with the upper metal case 71, together with the upper case 51 of the housing assembly 5. Therefore the slide assembly 81 is coupled together with the metal body assembly 7 and the housing assembly 5.

As shown in FIG. 1, the jack assembly 1 includes a plurality of terminals 2, and a stopper 3. The terminals 2 are electrical terminals providing electric conductivity. The terminals 2 are lined in an array and attached with a stopper 3 in the end thereof. As can be see in FIG. 1, the stopper 3 and the terminals 2 are together housed inside the jack assembly 1. In one embodiment, jack assembly 1 and the stopper 3 are made by non-conductive material.

As shown in FIG. 1, the metal body assembly 7 has an upper metal case 71 and a lower metal case 72. The metal body assembly 7 is placed inside the housing assembly 5. FIG. 2 shows a wire connector system 100 with the housing assembly 5. FIG. 2 shows the wire connector system with the removal of the upper metal case 71. As can be seen in FIGS. 3-5, the metal body assembly 7 is engaged with the plug assembly 4, the rear part of slide assembly 81, and the wire cable 6. The lower metal case 72 has at least one side slab 76 projected on the side thereof. The numbers of the side slab 76 can range from single to plural numbers depending on the numbers of the springs 9 used. The spring 9 is placed on the medial or lateral side of the lower case 52 in the housing assembly 5, along the side of the metal body assembly 7. In the present invention as shown in FIG. 1, In an engaged configuration as shown in FIGS. 3-4, there are two springs 9 being set aside on the metal body assembly 7 and the lower case 52 of the housing assembly 5. As shown in FIG. 1, one end of the spring 9 is placed against the side slab 76 of the lower metal case 72 for providing a resilient force for sliding manipulation of the plug assembly 4 in an outward or inward fashion from the female receptor. The springs 9 together with the coupled mechanism with the sliding assembly 81 provide a retractable force to move the plug assembly 4 in or out of the female receptor. In one embodiment, such coupled mechanism may include the housing assembly 5, the jack assembly 1, the metal body assembly 7, and the wire 6. In another embodiment, the coupled mechanism may include the housing assembly 5, the jack assembly 1 and the wire 6. The detailed descriptions of the slidable movement of slide assembly 81 triggered by the coupled mechanism to moveably connect the plug assembly 4 are explained in the following paragraphs.

The lower metal case 72 of the metal body assembly 7 further contains an approximately V-shaped component 74 for receiving and positioning the cable 6. The upper metal case 71 has a front component attached with the plug assembly 4, and a rear component containing a latch 78 for receiving the cable 6. The latch 78 further provides a push force to firmly press the cable down. When the upper metal case 71 and the lower metal case 72 are engaged together, the cable 6 is positioned and engaged tightly with the metal body assembly 7.

The present invention provides a moveable plug assembly 4 triggered by the slidable slide assembly 81 together with a coupled mechanism when the user manipulates the housing assembly 5. In one embodiment, the coupled mechanism includes the housing assembly 5, the metal body assembly 7, the jack assembly 1, and the cable 6 adapted together and moved or "triggered" by the slide assembly 81. The front component of the upper metal case 71 includes a pair of sliding slots 711 configured corresponding to the pair of cylindrical projections 82 of the slide assembly 81, as well as the inside sliding slots features of the upper case 51 of the housing assembly 5 (figure not shown). In one embodiment, the inside surface of the upper case 51 contains a pair of slot members (not shown). The slot members of the inside upper case 51 are arranged in the approximately same position corresponding to the sliding slots 711 of the upper metal case 71. With this arrangement, the cylindrical projections 82 of the slide assembly 81 can be slidably hooked with the sliding slots 711 of the metal body assembly 7, through the corresponding sliding members of the housing assembly 5. To plug in the wire connector system 100 of the present invention into the female receptor, the housing assembly 5 can be moved by the user and therefore the coupled assembly move forward together by the slide assembly 81. Since the slide assembly 81 is moveable between the cable 6 toward the plug assembly 4, the triggered mechanism by the slide assembly 81 is able to create a push force pulling the plug assembly 4 out of the housing assembly 5 toward the female receptor. In a forward movement of the coupled mechanism including the housing assembly 5, the slide assembly 81 can move forwardly within a predetermined distance "L" until touching and holding against the plug assembly 4, therefore the wire connector system 100 is being biased to engage with the female receptor. Such engaged configuration driven by the resilient biased force further creates the frictional contacts between the male wire connector system 100 and the female receptor, therefore improves the engagement in between. The predetermined distance "L" is shown in FIG. 5 approximately the distance between the rear part of the slide assembly and the cable 6. In a backward movement of the coupled mechanism including the housing assembly 5, the slide assembly 81 can move forwardly within the predetermined distance until touching the cable 6. The backward movement can trigger the plug assembly 4 out from the female receptor and release therefrom.

In the present invention, a safety locking mechanism for the wire connector system 100 is enhanced by providing the hollow T-shaped cavity 41 and the flexible projections 42. As shown in FIGS. 1-4, the top portion of the plug assembly 4 contains a hollow T-shaped cavity 41, a pair of the flexible projections 42 placed within the T-shaped cavity 41. In another embodiment, there is one flexible projection 42 within the cavity 41. Still in another embodiment, there can be a plural of projections 42. The cavity 41 and the projections 42 are applied to facilitate the locking position between the wire system 100 and the female receptor. When the plug assembly 4 is inserted into the female receptor, the projections 42 are being pressed inwardly and then positioned outwardly biased against the female receptor. The safety locking mechanism between the male connector system 100 and the female receptor is enhanced by the flexible projection 42 and the cavity 41 which are interlocked together when the male connector 100 is inserted into the female receptor. Therefore the male wire system 100 can be securely locked with the female receptor.

Figure 6:
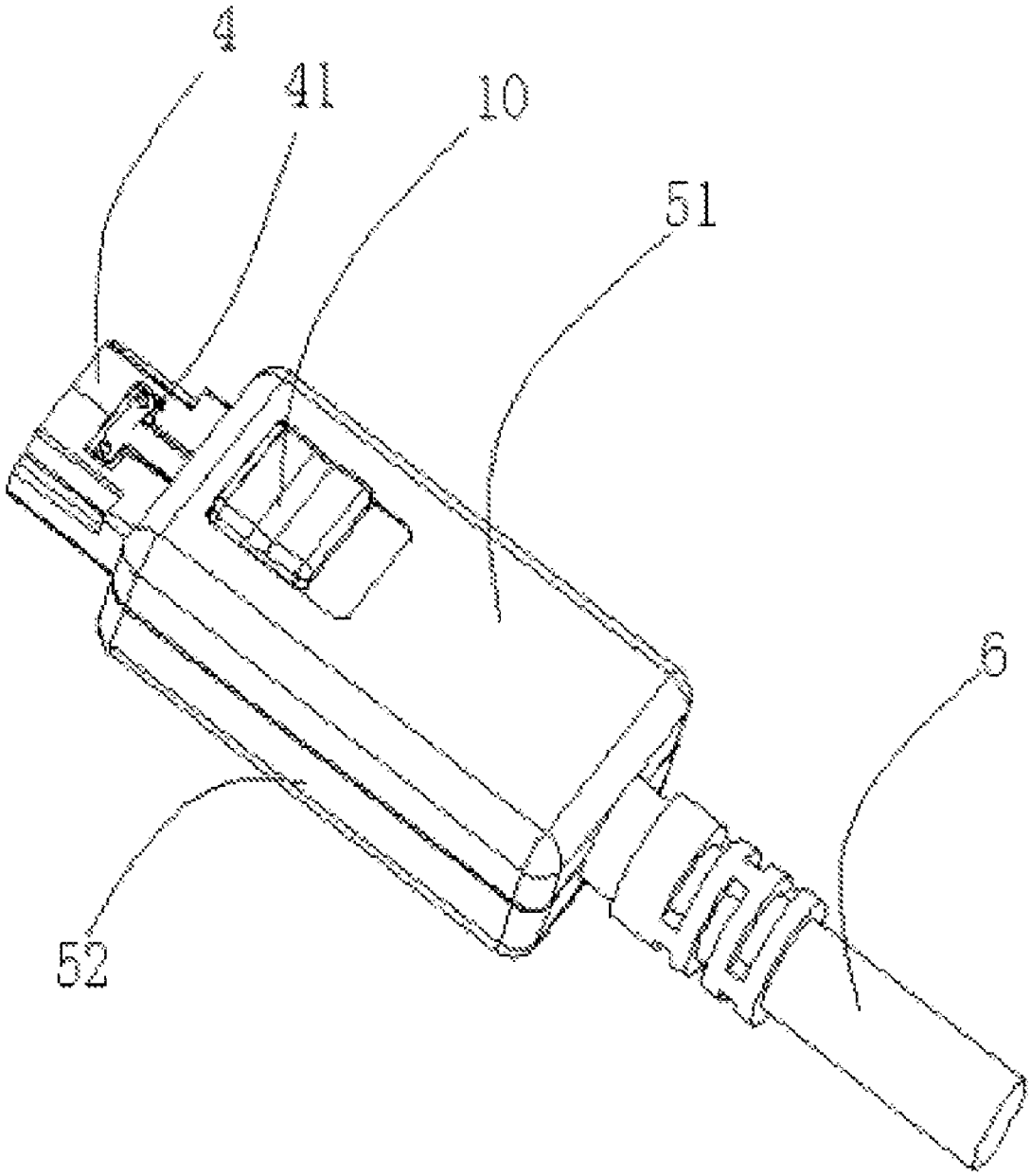
FIG. 6 is another embodiment of the wire connector system of FIG. 1 with a slide handle mounted on the top of the non-conductive upper case in a coupled position.

In one embodiment of the slide assembly 81 of the present invention, the slide assembly 81 further includes a sliding bar 10 attached on the top thereof (ie, the proximal side as shown in FIG. 6) and protruded outside the upper case 51 of the housing assembly 5. As shown in FIG. 6, the sliding bar 10 of the slide assembly 81 is located within the corresponding cavity of the upper case 51. In another embodiment, the sliding bar 10 can be attached to the bottom thereof (ie, the distal side) and protruded outside the lower case 52 of the housing assembly. The sliding bar 10 can be located within a corresponding cavity within the lower case 52 of the housing assembly 5.

Figure 7:
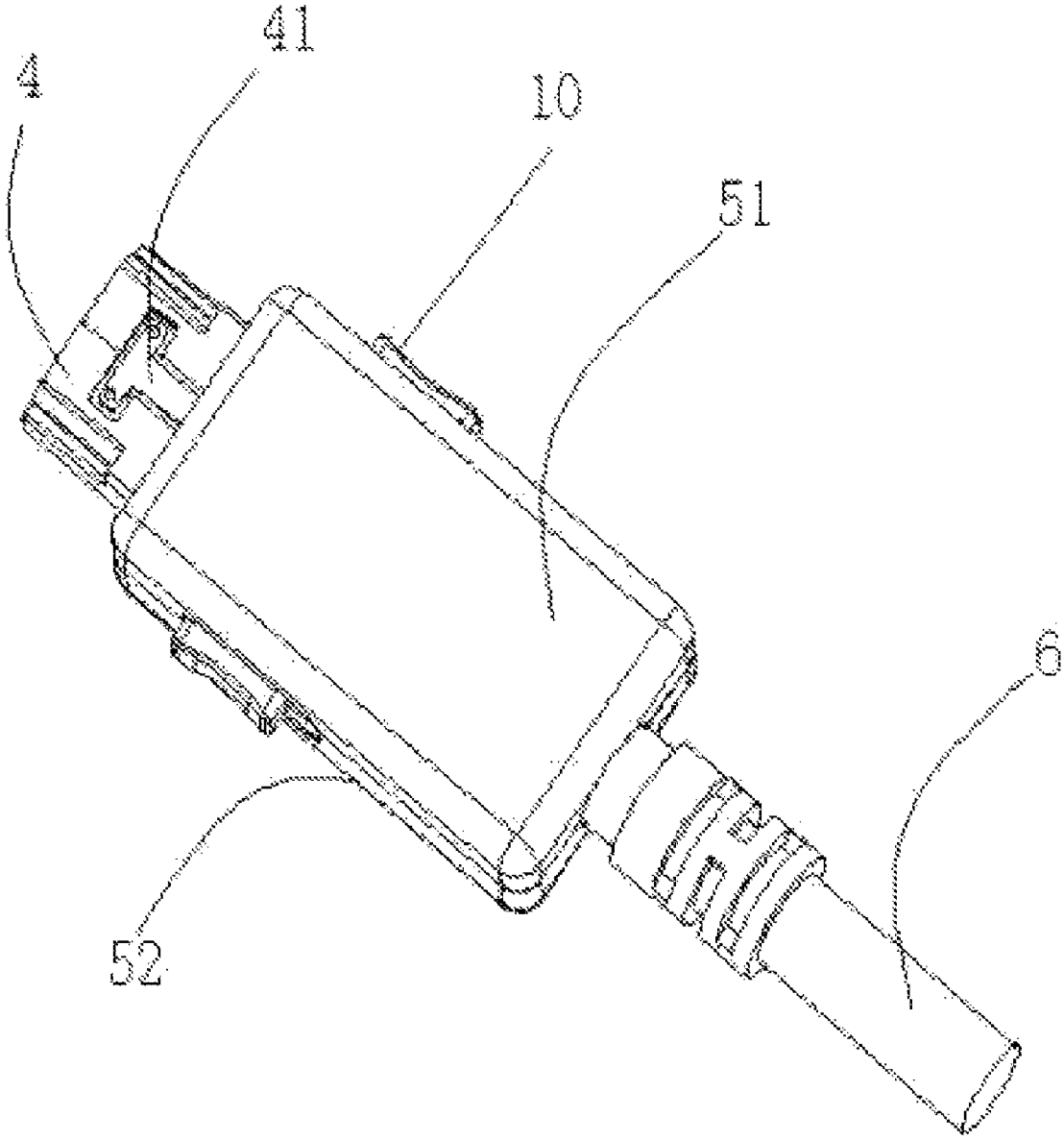
FIG. 7 is another embodiment of the wire connector system of FIG. 1 with a pair of side elastic tabs in a coupled position.

In another embodiment of the slide assembly 81 of the present invention, the slide assembly 81 further includes a pair of elastic tabs 10 on its medial and lateral sides thereof, as shown in FIG. 7. The elastic tabs 10 on the medial and the lateral parts of the slide assembly 81 are each located within a corresponding medial and lateral cavities accordingly of the housing assembly 5.

In another embodiment of the wire connector system 100, the metal case assembly 70 is not necessarily included in the present invention. The front part 8 of the slide assembly 81 containing a tongue FIG. 8 is inserted into the plug assembly 4. The rear part of the slide assembly 81 containing a pair cylindrical projections 82 can be directly hooked with the corresponding slots of the housing assembly 5 located in the inner upper case 51 (figure not shown). Still in another embodiment when the metal case assembly 70 is not present, the rear part of the slide assembly 81 containing a pair of sliding slots 82 can be directly hooked with the corresponding protruded projections located inside the upper case 51 of the housing assembly 5 (figure not shown). Therefore in a slidable movement of the plug assembly 4, the coupled mechanism in this embodiment includes a housing assembly 5, a jack assembly 1, and the cable 6. To plug in the wire connector system 100 of the present invention into the female receptor, the housing assembly 5 can be moved by the user and therefore the coupled assembly move forward together by the slide assembly 81. Since the slide assembly 81 is moveable between the cable 6 toward the plug assembly 4, the triggered mechanism by the slide assembly 81 is able to create a push force pulling the plug assembly 4 out of the housing assembly 5 toward the female receptor. In a forward movement of the coupled mechanism including the housing assembly 5, the slide assembly 81 can move forwardly within a predetermined distance "L" until touching and holding against the plug assembly 4, therefore the wire connector system 100 is being biased to engaged the female receptor in a locked configuration. The predetermined distance "L" is approximately the distance between the rear part of the slide assembly and the cable 6. In a backward movement of the coupled mechanism including the housing assembly 5, the slide assembly 81 can move forwardly within the predetermined distance until touching the cable 6. The backward movement can trigger the plug assembly 4 out from the female receptor and release therefrom.

In one embodiment of the slide assembly 81 of the present invention without the metal body assembly 7, the slide assembly 81 further includes a sliding bar 10 attached on the top thereof (ie, the proximal side as shown in FIG. 6) and protruded outside the upper case 51 of the housing assembly 5. As shown in FIG. 6, the sliding bar 10 of the slide assembly 81 is located within the corresponding cavity of the upper case 51. In another embodiment of the slide assembly 81, the sliding bar 10 can be attached to the bottom thereof (ie, the distal side) and protruded outside the lower case 52 of the housing assembly. The sliding bar 10 can be located within a corresponding cavity within the lower case 52 of the housing assembly 5.

Still in another embodiment of the slide assembly 81 of the present invention without the metal body assembly 7, the slide assembly 81 further includes a pair of elastic tabs 10 on its medial and lateral sides thereof, as shown in FIG. 7. The elastic tabs 10 on the medial and the lateral parts of the slide assembly 81 are each located within a corresponding medial and lateral cavities accordingly of the housing assembly 5.

Although the present invention has been described with reference to preferred embodiment, persons skilled in the art will recognize that changes may be made in form and detail without departing from the spirit and scope of the invention.

What is claimed is:

1. A male wire connector system with lock mechanism, comprising:

a housing assembly, comprising an upper case and a lower case, said housing assembly having a first end containing a wire aperture to engage a conductive cable and a second end disposed opposite said first end;

a plug assembly moveably connected to said second end of said housing assembly and housed partially within said housing assembly;

a jack assembly engaged within said plug assembly, comprising a plurality of terminals engaged in a lined array and attached to a stopper mounted at the end portions thereof and housed with said jack assembly;

a cable extended through and outwardly from said housing assembly; and a slide assembly disposed on the top of said jack assembly capable of being slidably moved between said plug assembly and said cable by manipulation, comprising a front part being slidably inserted into said plug assembly and a rear part being slidably inserted into said upper case of said housing assembly;

wherein said housing assembly, said jack assembly and said cable are adapted to couple with said slide assembly being capable of moving in a forward or a backward directions within a predetermined distance for allowing the retractable movement of said plug assembly;

wherein the forward movement of said slide assembly within predetermined distance provides a resilient push force making said plug assembly outward from said housing assembly and being biased to engage with a female receptor;

wherein the backward movement of said slide assembly within predetermined distance provides a resilient retractable force releasing said plug assembly from the female receptor.

2. The connector system of claim 1, wherein said upper case and said lower case of said housing assembly, and said stopper of said jack assembly are composed of non-conductive material.

3. The connector system of claim 2, wherein said housing assembly comprises at least one spring placed in medial or lateral side of said lower case of said housing assembly.

4. The connector system of claim 3, wherein the top portion of said plug assembly comprises an approximately T-shape cavity and at least one flexible projection placed within said cavity.

5. The connector system of claim 4, wherein said predetermined distance is the distance between said rear part of slide assembly and said cable.

6. The connector system of claim 5, wherein said rear part of said slide assembly comprises a pair of cylindrical projections, and wherein said upper case of said housing assembly comprise a pair of slot members inside thereof, allowing said slide assembly to slidably inserted with said housing assembly in an engaged configuration.

7. The connector of claim 5, wherein said rear part of said slide assembly comprises a pair of sliding slots, and wherein said corresponding portions of said upper case of said housing assembly comprise a pair of protruded projections inside thereof, allowing said slide assembly to slidably inserted with said housing assembly in an engaged configuration.

8. The connector system of claim 6, wherein the medial and lateral sides of said slide assembly comprise a pair of elastic tabs protruded outside of said housing assembly, wherein the medial and lateral sides of said housing assembly comprise a pair of openings to correspondingly engage with said elastic tabs of said slide assembly.

9. The connector system of claim 6, wherein the proximal or the distal side of said slide assembly comprises a sliding bar protruded outside of said housing assembly, wherein the upper case or the lower case of said housing assembly comprises a cavity being correspondingly engaged with said sliding bar of said slide assembly.

10. The connector system of claim 7, wherein the medial and lateral sides of said slide assembly comprise a pair of elastic tabs protruded outside of said housing assembly, wherein the medial and lateral sides of said housing assembly comprise a pair of openings being correspondingly engaged with said elastic tabs of said slide assembly.

11. The connector system of claim 7, wherein the medial and lateral sides of said slide assembly comprise a pair of elastic tabs protruded outside of said housing assembly, wherein the medial and lateral sides of said housing assembly comprise a pair of openings being correspondingly engaged with said elastic tabs of said slide assembly.

12. A male wire connector system with lock mechanism, comprising:

a housing assembly, comprising an upper case and a lower case, said housing assembly having a first end containing a wire aperture to engage a conductive cable and a second end disposed opposite said first end;

a plug assembly moveably connected to said second end of said housing assembly and housed partially within said housing assembly;

a jack assembly engaged within said plug assembly, comprising a plurality of terminals engaged in a lined array and attached to a stopper mounted at the end thereof and housed with said jack assembly;

a metal body assembly housed within said housing assembly connected with the slide assembly and said cable wire, said metal body assembly comprising an upper metal case slidably engaged with said slide assembly, and a lower metal case engaged partially with said cable, said jack assembly and said slide assembly;

a cable extended through and outwardly from said housing assembly and the metal body assembly; and a slide assembly disposed on the top of said jack assembly capable of being slidably moved between said plug assembly and said cable by manipulation, comprising, a front part being slidably inserted into said plug assembly, and a rear part being slidably inserted into said upper case of said metal body assembly through said upper case of said housing assembly;

wherein said housing assembly, said metal case body, said jack assembly and said cable are adapted to couple with said slide assembly being capable of moving in a forward or a backward directions within a predetermined distance for allowing the retractable movement of said plug assembly;

wherein the forward movement of said slide assembly within predetermined distance provides a resilient push force making said plug assembly outward from said housing assembly and being biased to engage with a female receptor;

wherein the backward movement of said slide assembly within predetermined distance provides a resilient retractable force releasing said plug assembly from the female receptor.

13. The connector system of claim 12, wherein said upper case and said lower case of said housing assembly, and said stopper of said jack assembly are composed of non-conductive material.

14. The connector system of claim 13, wherein said housing assembly comprises at least one spring placed in medial or lateral side of said lower case of said housing assembly.

15. The connector system of claim 14, wherein said lower metal case of said metal body assembly comprises at least one side slab arranged in a manner holding against said spring located in said housing assembly.

16. The connector system of claim 15, wherein the top portion of said plug assembly comprises an approximately T-shape cavity and at least one flexible projection placed within said cavity.

17. The connector of claim 16, wherein said upper metal case of said metal body assembly comprises a latch and said lower metal case comprises a corresponding V-shaped member for engaging and positioning said wire.

18. The connector system of claim 17, wherein said rear part of said slide assembly comprises a pair of cylindrical projections, wherein said upper metal case of said metal body assembly comprises a pair of sliding slots, and wherein said upper case of said housing assembly comprise a pair of slot members in the inner side thereof, allowing said slide assembly to slidably inserted with said metal body assembly through said housing assembly in a engaged configuration.

19. The connector of claim 17, wherein said rear part of said slide assembly comprises a pair of sliding slots, wherein said upper metal case of said metal body assembly comprises a pair of sliding members in the inner side thereof, and wherein said upper case of said housing assembly comprise a pair of protruded projections, allowing said slide assembly to slidably inserted with said metal body assembly through said housing assembly in a engaged configuration.

20. The connector system of claim 18, wherein the medial and lateral sides of said slide assembly comprise a pair of elastic tabs protruded outside of said housing assembly, wherein the medial and lateral sides of said housing assembly comprise a pair of openings to correspondingly engage with said elastic tabs of said slide assembly.

21. The connector system of claim 18, wherein the proximal or the distal side of said slide assembly comprises a sliding bar protruded outside of said housing assembly, wherein the upper case or the lower case of said housing assembly comprises a cavity being correspondingly engaged with said sliding bar of said slide assembly.

22. The connector system of claim 19, wherein the medial and lateral sides of said slide assembly comprise a pair of elastic tabs protruded outside of said housing assembly, wherein the medial and lateral sides of said housing assembly comprise a pair of openings being correspondingly engaged with said elastic tabs of said slide assembly.

23. The connector system of claim 19, wherein the medial and lateral sides of said slide assembly comprise a pair of elastic tabs protruded outside of said housing assembly, wherein the medial and lateral sides of said housing assembly comprise a pair of openings being correspondingly engaged with said elastic tabs of said slide assembly.

* * * * *